US010342275B2

(12) United States Patent
Dames, III et al.

(10) Patent No.: US 10,342,275 B2
(45) Date of Patent: Jul. 9, 2019

(54) RELEASABLE, SECURE CLOTHING CONNECTORS

(71) Applicant: SHOWSTOPPER, LLC, Woodbridge, VA (US)

(72) Inventors: Joseph Edward Dames, III, Woodbridge, VA (US); Micah Joel Dames, Woodbridge, VA (US)

(73) Assignee: SHOWSTOPPER LLC, Woodbridge, VA (US)

( * ) Notice: Subject to any disclaimer, the term of this patent is extended or adjusted under 35 U.S.C. 154(b) by 424 days.

(21) Appl. No.: 14/841,068

(22) Filed: Aug. 31, 2015

(65) Prior Publication Data

US 2017/0055613 A1 Mar. 2, 2017

(51) Int. Cl.

| | |
|---|---|
| ***A41F 1/00*** | (2006.01) |
| ***A41D 27/08*** | (2006.01) |
| ***A41D 7/00*** | (2006.01) |
| ***A41F 15/00*** | (2006.01) |

(52) U.S. Cl.

CPC ..... *A41F 15/002* (2013.01); *A41D 7/00* (2013.01); *A41D 27/08* (2013.01); *A41F 1/006* (2013.01)

(58) Field of Classification Search

CPC ..... A41D 27/08; A41F 1/006; A41F 15/002; A41F 15/00

USPC ..... 2/301, 326, 327, 338; 24/265 R, 570, 24/910; 450/85, 86, 88

See application file for complete search history.

(56) References Cited

U.S. PATENT DOCUMENTS 3,115,878 A * 12/1963 Markham ..... A41F 15/002 2/73
3,161,931 A * 12/1964 Zif ..... A41F 1/006 24/200
4,031,900 A 6/1977 Guidoni
6,009,556 A 1/2000 Nenninger
(Continued)

FOREIGN PATENT DOCUMENTS

KR 1020040042295 5/2004

OTHER PUBLICATIONS

Printed webpage of (1 page): http://m.alibaba.com/product/60271781648/Dongguan-strapless-bra-adjuster-clip.html.
(Continued)

*Primary Examiner* — Katherine M Moran
(74) *Attorney, Agent, or Firm* — Duane Morris LLP; Gregory M. Lefkowitz; Jason M. Nolan

(57) ABSTRACT

A clothing system includes a clothing component having a first coupling portion and a second coupling portion. The first coupling portion includes a first clothing coupling element and the second coupling portion includes a second clothing coupling element. A linking element includes first and second linking coupling elements at opposite ends. Each of the first clothing coupling element, the second clothing coupling element, the first linking coupling element, and the second linking coupling element is selected from the group consisting of: (A) a clasp, comprising a loop receiving projection extending from a first longitudinally-extending edge, and a primary securing clip that is closed along a second longitudinally-extending edge; and (B) a loop adapted for sliding over said loop receiving projection. The first and second clothing coupling elements are adapted to be removably coupled to the first and second linking coupling elements, respectively.

7 Claims, 10 Drawing Sheets

(56) References Cited

U.S. PATENT DOCUMENTS

| | | | | |
|---|---|---|---|---|
| 6,186,861 | B1 * | 2/2001 | Flaherty | A41C 3/00 450/1 |
| 7,232,359 | B1 | 6/2007 | Richardson | |
| 7,819,721 | B1 * | 10/2010 | Messier | A41D 27/08 2/244 |
| 8,408,964 | B1 | 4/2013 | Acker et al. | |
| 2004/0128733 | A1 | 7/2004 | Hendricks | |
| 2006/0174514 | A1 | 8/2006 | Scozzafava | |
| 2011/0289646 | A1 | 12/2011 | Scozzafava | |
| 2012/0272427 | A1 | 11/2012 | Scozzafava | |
| 2014/0127970 | A1 | 5/2014 | Dionne | |

OTHER PUBLICATIONS

Printed webpage (4 pages) of: http://www.dhgate.com/store/product/rhinestone-bra-strap-2row-for-party-1pc-lot/123567979.html.
Printed webpage (2 pages) of: http://m.danceshopper.com/dance-supplies.Rhinestone-Bra-Straps.

* cited by examiner

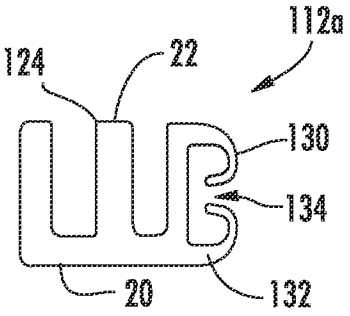
FIG. 4A
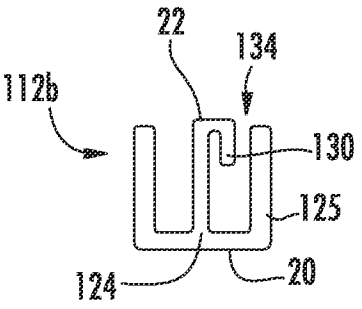
FIG. 4B
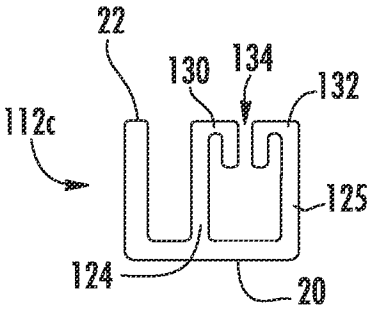
FIG. 4C
FIG. 4D
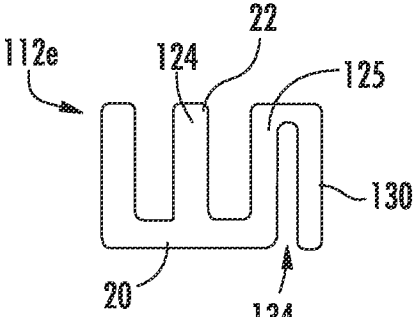
FIG. 4E
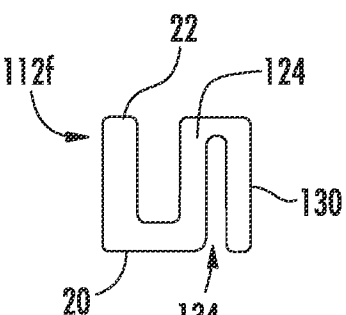
FIG. 4F

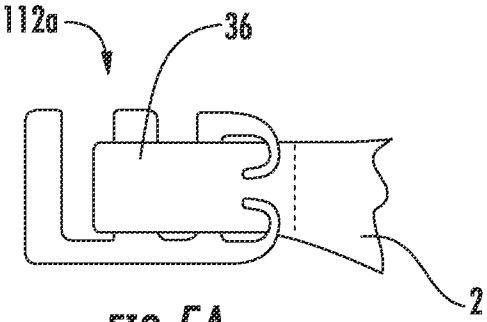
FIG. 5A
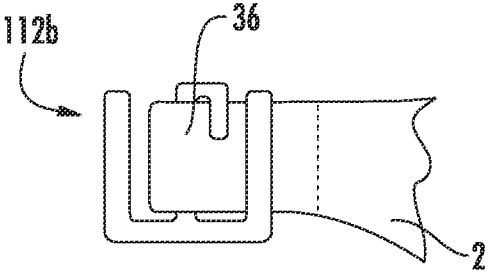
FIG. 5B
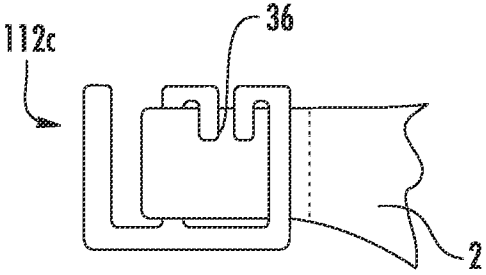
FIG. 5C
FIG. 5D
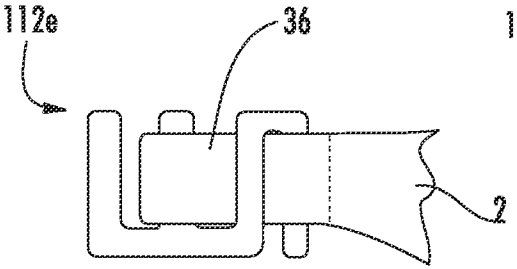
FIG. 5E
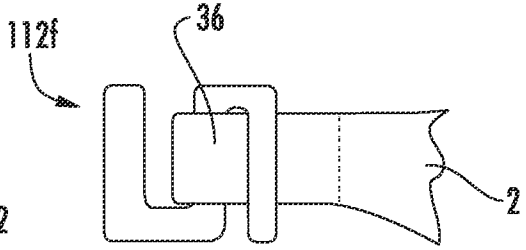
FIG. 5F

RELEASABLE, SECURE CLOTHING CONNECTORS

BACKGROUND

In image-related competitions, such as body-building competitions or beauty pageants, contestants are required to wear articles of clothing revealing of and complimentary to their physical appearance. In these instances, the clothing article itself is part of the presentation of the competitor. Current clothing articles have feed elements providing only a single ornamental design. Contestants are constrained by the predetermined designs and fit of the clothing article.

SUMMARY

In various embodiments, a clothing system is disclosed. The clothing system includes a clothing component and a linking element. The clothing component has a first coupling portion and a second coupling portion. The first coupling portion includes a first clothing coupling element and the second coupling portion includes a second clothing coupling element. The linking element includes first and second linking coupling elements at opposite ends of the linking element. Each of the first clothing coupling element, the second clothing coupling element, the first linking coupling element, and the second linking coupling element is selected from the group consisting of: (A) a clasp, comprising a loop receiving protection extending from a first longitudinally-extending edge of the clasp, and a primary securing clip that is closed along a second longitudinally-extending edge of the clasp opposite said first longitudinally-extending edge; and (B) a loop adapted for sliding over said loop receiving projection. The first and second clothing coupling elements are adapted to be removably coupled to the first and second linking coupling elements, respectively. When the clothing component and the linking component are coupled together, they comprise at least a portion of an article of clothing that can be worn by a wearer.

In various embodiments, a clothing system, is disclosed. The clothing system includes a clothing component having a first portion and a linking element. The first portion includes a first clothing coupling element. The linking element includes a first linking coupling element. The first clothing coupling element includes a clasp having a loop receiving projection extending from a first longitudinally-extending edge of the clasp and a primary securing clip that is closed along a second longitudinally-extending edge of the clasp opposite the first longitudinally-extending edge. The first linking coupling element comprises a loop adapted for sliding over the loop receiving projection. The first clothing coupling element is adapted to be removably coupled to the first linking coupling element. When the clothing component and the linking element are coupled together, they comprise at least a portion of an article of clothing that can be worn by a wearer.

BRIEF DESCRIPTION OF THE FIGURES

The features and advantages of the present invention will be more fully disclosed in, or rendered obvious by the following detailed description of the preferred embodiments, which are to be considered together with the accompanying drawings wherein like numbers refer to like parts and further wherein:

FIGS. 4A-4F illustrate various embodiments of linking coupling elements and coupling elements, in accordance with the present disclosure.

FIGS. 5A-5F illustrate the various embodiments of linking coupling elements and coupling elements of FIGS. 4A-4F coupled together, in accordance with the present disclosure.

DETAILED DESCRIPTION

Figure 1:
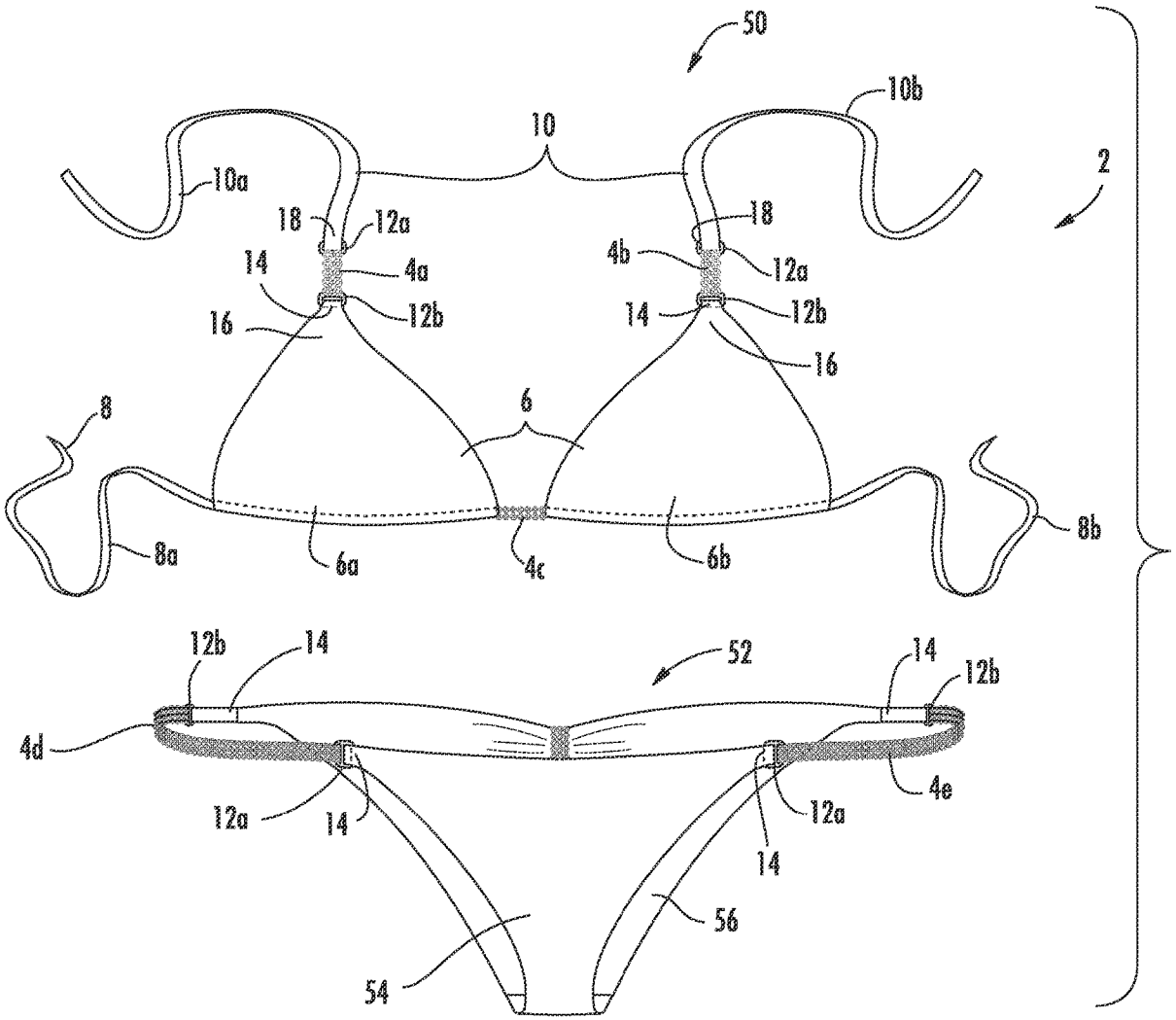
FIG. 1 illustrates one embodiment of a clothing component having a linking element coupled to first and second coupling elements, in accordance with the present disclosure.

The description of the preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In this description, relative terms such as "horizontal," "vertical," "up," "down," "top," "bottom," as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both moveable or rigid attachments or relationships, unless expressly described otherwise, and includes terms such as "directly" coupled, secured, etc. The term "operatively coupled" is such, an attachment, coupling, or connection that allows the pertinent structures to operate as intended by virtue of that relationship.

In various embodiments, a linking element is disclosed for a clothing article. The linking element is sized and configured to couple a first fabric portion of a clothing article to a second portion of the clothing article. For example, in some embodiments, the linking element couples a first portion of a bikini top to a second portion of the bikini top. In another embodiment, the linking element couples a first portion of a fabric section to a second portion of the same fabric section of the clothing article. Although various embodiments are discussed herein with respect to bathing suit pieces, it will be appreciated that the linking element may be configured for any suitable clothing item.

In various embodiments, an article of clothing having one or more linking elements is disclosed. The linking elements are sized and configured to link a first portion of the article of clothing to a second portion of the article of clothing such that when the article of clothing and the linking element are coupled together, the article of clothing may be worn by a wearer. In some embodiments, the article of clothing includes a plurality of coupling elements configured to link to linking coupling elements formed on the one or more linking elements.

Figure 2:
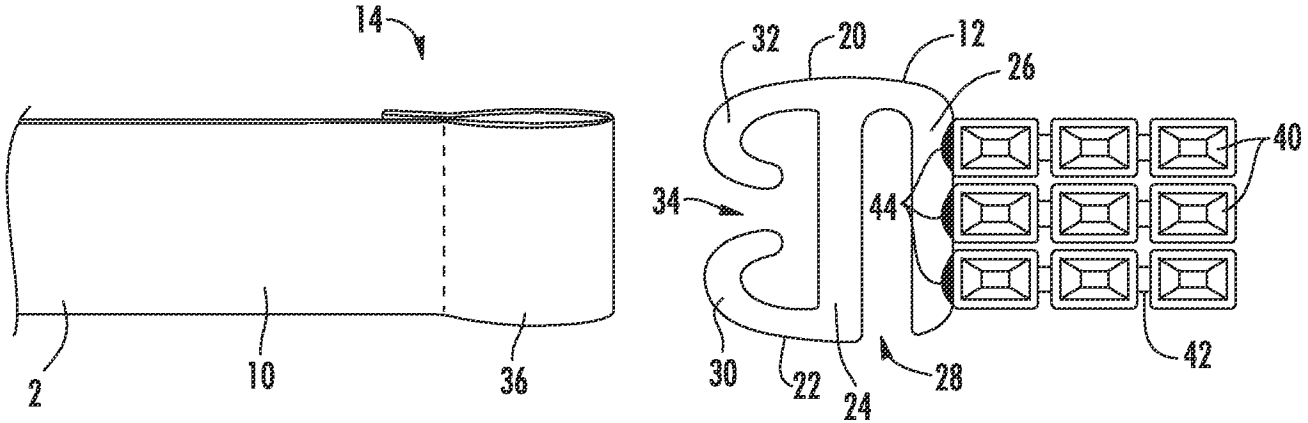
FIG. 2 illustrates one embodiment of a linking coupling element of a linking element and a coupling element of a clothing component, in accordance with the present disclosure.
Figure 3:
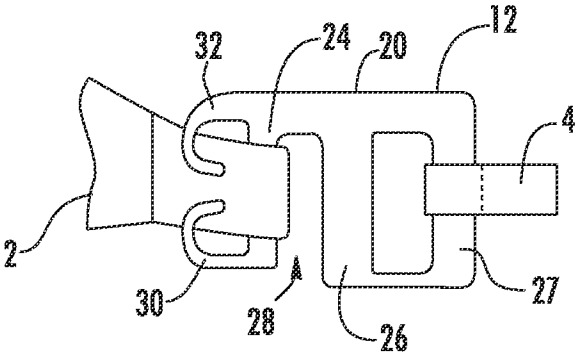
FIG. 3 illustrates one embodiment of the linking coupling element and the coupling element of FIG. 2 coupled together.

FIGS. 1-3 illustrate one embodiment of a clothing article 2 having one or more linking elements 4*a*, 4*b*, 4*c*, 4*d*, 4*e* (collectively "linking elements 4") coupled thereto. In the illustrated embodiment, the clothing article 2 comprises a two-piece bathing suit (e.g., a bikini) having a top piece 50 and a bottom piece 52, although it will be appreciated that the clothing article 2 can comprise any suitable garment, such as, for example, a single-piece bathing suit, undergarments (including bras, panties, briefs, etc.), dresses, blouses, shirts, two-piece bathing suits, figure suits, physique suits, bodybuilding suits, posing suits and/or any other suitable garment configured for male and/or female wearers. The top piece 50 includes a cup section 6, a chest strap 8, and neck, straps 10. The bottom piece 52 includes a front section 54 and a back section 56. In some embodiments, the linking elements 4 are coupled to coupling portions of the clothing article 2 located on separate fabric portions. For example, in the illustrated embodiment, the neck straps 10*a*, 10*b* of the top piece 50 are coupled to the cups 6*a*, 6*b* by respective first linking element 4*a* and second linking element 4*b*. A third linking element 4*c* extends between the coupling elements on the cups 6*a*, 6*b*. In some embodiments, the linking elements 4 are coupled to coupling elements at different positions on a single component of the clothing, article 2 to define an opening for a body part, such as a torso, leg, neck, or arm opening. For example, in the illustrated embodiment, a fourth linking element 4*d* and a fifth linking element 4*e* couple the front portion 54 of the bottom piece 52 to the back portion 56. It will be appreciated that the clothing article 2 may contain additional coupling portions for receiving additional linking elements 4. For example, in some embodiments, a linking element 4 may be coupled between the first lateral strap 8*a* and the second lateral snap 8*b* of the top piece 50. In other embodiments, one or more of the Illustrated linking elements 4 may be omitted, such as, for example, the linking element 4*c* located between the cups 6*a*, 6*b*.

In various embodiments, each of the linking elements 4 extends substantially longitudinally between a first linking coupling element 12*a* at a first end and a second linking coupling elements 12*b* at a second end, opposite the first end. The linking coupling elements 12*a*, 12*b* are configured to couple the linking elements 4 to one or more clothing coupling elements 14 (see FIG. 2) located on the clothing article 2. For example, in the illustrated embodiment, coupling elements 14 are located at the apex 16 of the each of the cups 6*a*, 6*b*, at a first end 18 of each of the neck straps 10*a*, 10*b*, at an inside edge of each of the cups 6*a*, 6*b*, and at outside corners of each of the front section 54 and the back section 56 of the bottom portion 52. It will be appreciated that where one more of the linking elements 4 is omitted (for example, between the cups 6*a*, 6*b*), the clothing coupling elements 14 may also be omitted (for example, on the inside corners of the cups 6*a*, 6*b*) and/or replaced with a fabric connector.

The linking coupling elements 4 can comprise any suitable device for coupling the linking elements 4 to the clothing coupling elements 14. In various embodiments, the linking coupling elements 4 and/or the clothing coupling elements 14 are releasable to allow the linking elements 4 and the clothing article 2 to be selectively separated. Although the embodiments herein are illustrated having the linking coupling elements 12*a*, 12*b* coupled to the linking elements 4 and the clothing coupling elements 14 formed on the clothing article 2, it will be appreciated that the linking coupling elements 12 and the clothing coupling elements 14 may be reversed (e.g., the linking coupling elements 12 coupled to the clothing article and the clothing coupling elements 14 coupled to the linking elements 12).

In some embodiments, the linking coupling elements 4 each include a clasp 12 having a first longitudinally-extending edge 20 and a second longitudinally-extending edge 22. A loop receiving projection 24 extends from the first longitudinally-extending edge 20. The loop receiving projection 24 is spaced apart from a lateral edge 26 of the clasp 12 to define a loop receiving cavity 28 therebetween. A primary securing clip 30 is coupled to and closed along the second longitudinally-extending edge 22. In some embodiments, a secondary securing clip 32 is coupled to and closed along the first longitudinally-extending edge 20 of the clasp 12. The primary securing clip 30 and/or the secondary securing clip 32 can extend from (e.g., at angle to) the loop receiving projection 24 and/or can extend parallel to the loop receiving projection 24. In some embodiments, as shown in FIGS. 2 and 3, the primary securing clip 30 extends from a distal end of the loop receiving projection 24 and the secondary securing clip 32 extends from a proximal end of the loop receiving projection 24.

The coupling portion 14 is sized and configured to couple to the linking coupling elements 12. In some embodiments, the coupling elements 14 each comprise a loop 36, such as a fabric loop, adapted to be slidingly received over the loop receiving projection 24 of the linking coupling element 12. In some embodiments, the loop 36 has a circumference sufficient to slide over the loop receiving projection 24, the primary securing clip 30, and the secondary securing clip 32. In other embodiments, the loop 36 has a circumference such that the loop 36 can slide over the loop receiving projection 24 but not the loop receiving projection 24, the primary securing clip 30, and the secondary securing clip 32 simultaneously. In some embodiments, the loop 36 can fee adjustable. When attached, the primary securing clip 30 and the secondary securing clip 32, if present, are positioned to allow the loop and/or the strap 10 that slides over the loop receiving portion 24 to pass through a clip access opening 34 defined by the primary securing clip 30 and/or the secondary securing clip 32. The loop 36 is retained on the loop receiving projection 24 by the primary securing clip 30 and the secondary securing clip 32 (if present). In some embodiments, the loop 36 and/or the strap 10 has a maximum lateral width that is wider than the clip access opening 34. In other embodiments, the loop 36 and/or the strap has a maximum lateral width less than or equal to the width of the clip access opening 34. In some embodiments, the loop 36 and/or the strap 10 is formed of a flexible material such that a wearer can slide it through the clip access opening 34.

FIG. 3 illustrates one embodiment of the linking coupling element 12 coupled to the coupling portion 14. In operation, the loop 36 is slideably coupled to the loop receiving protection 24. A portion of the loop 36 and/or the clothing article 2 (for example, strap 10) is threaded through the clip access opening 34. The primary securing clip 30 and the secondary securing clip 32 (if present) are positioned to maintain the position of the clothing article 2 with respect to the linking coupling element 12, preventing the loop 36 from sliding off of the loop receiving projection 24. In some embodiments, the portion of the clothing article 2 that passes through the clip access opening 34, such as the loop 36 and/or a strap 10, has a lateral width greater than the width of the clip access opening 34. As shown in FIG. 3, the greater lateral width can cause the primary securing clip 30 and the secondary securing clip 32 to compress portion of the clothing article 2 that passes through the clip access opening 34, providing greater retention of the clothing article 2. In some embodiments, the portion of the clothing article 2 that passes through the clip access opening 34 has a maximum lateral width less than or equal to the width of the clip access opening 34.

Figure 7A:
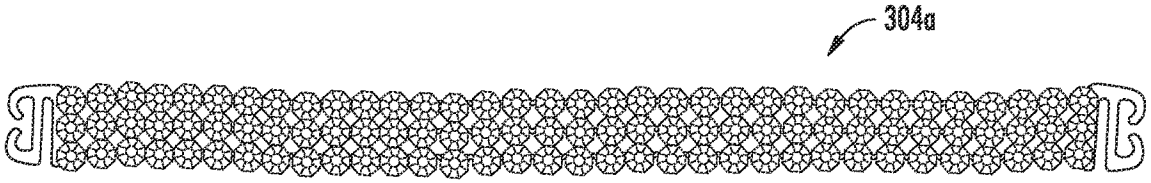
FIGS. 7A-7E illustrate embodiments of linking elements having various ornamental designs, in accordance with the present disclosure.
Figure 7B:
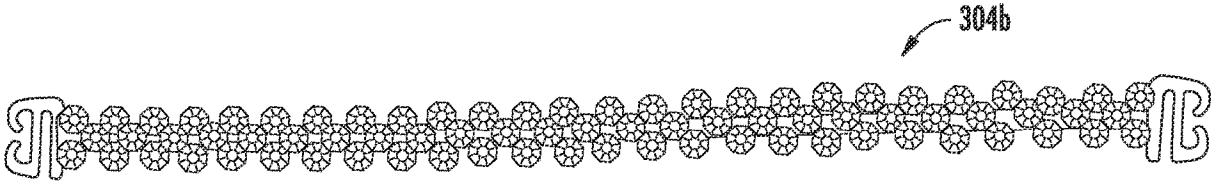
Figure 7C:
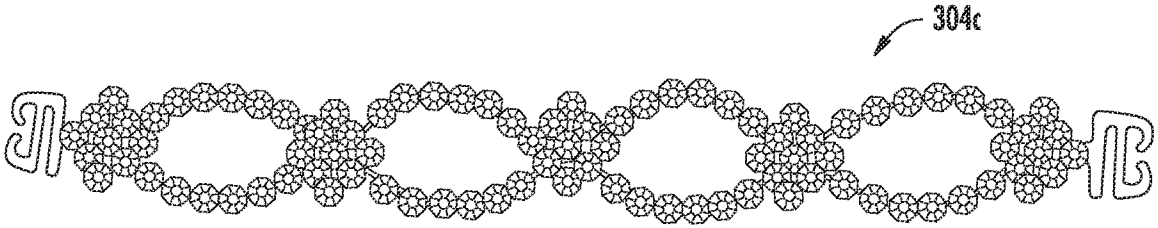
Figure 7D:
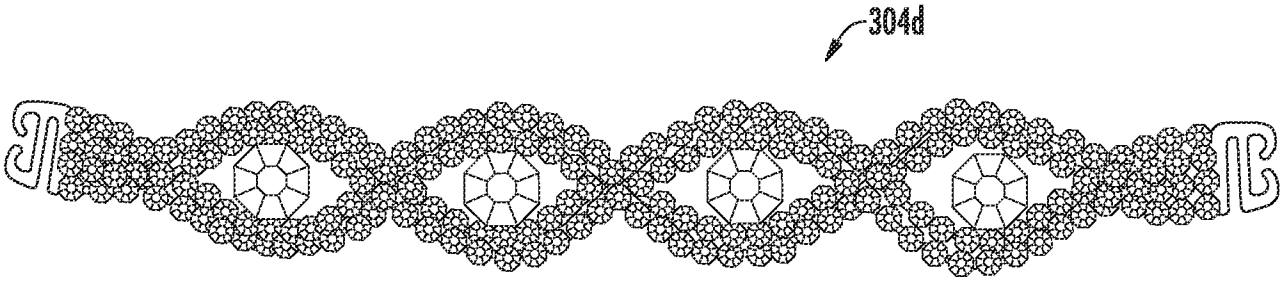
Figure 7E:
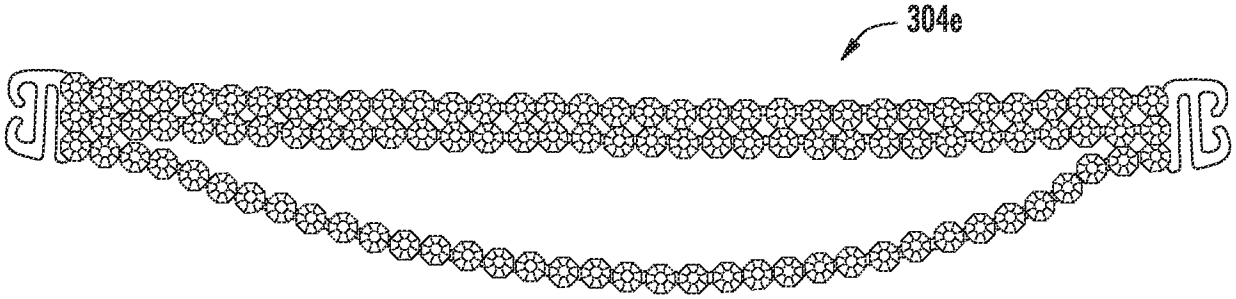
Figure 9:
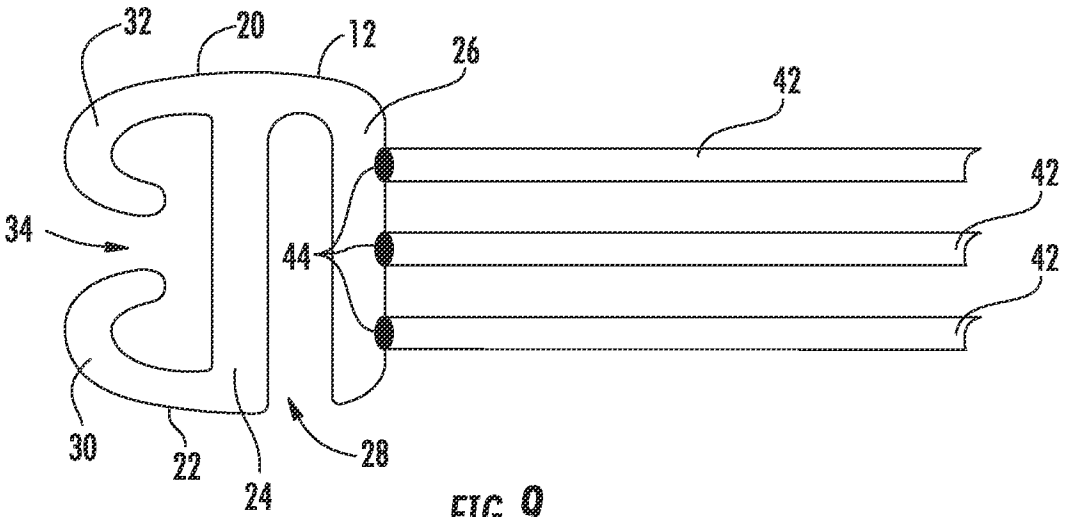
FIG. 9 illustrates one embodiment of a linking coupling element coupled to a plurality of wires.

In some embodiments, the linking element 4 comprises an ornamental linking element. For example, as shown in FIG. 2, the linking element 4 can comprise a plurality of ornamental elements 40 coupled to a plurality of wires 42. In some embodiments, each of the ornamental elements 40 can be linked to laterally or longitudinally adjacent ornamental elements 40, where the strand of linked ornamental elements 40 serves as the wire 42. FIG. 9 illustrates one embodiment of a linking coupling element 12 coupled to the plurality of wires 42. The linking coupling element 12 can be coupled to the plurality of wires 42 by any suitable method, such as a plurality of welds 44. In some embodiments, the ornamental elements 40 are cut from a spool (not shown) at a predetermined length. The predetermined length can depend on the intended position of the linking element 4 with respect to a user. For example, in some embodiments, a linking element 4 configured to be coupled to a bottom 52 and extend about a user's hip may have a predetermined length of 165 mm. As another example, a linking element 4 configured to be coupled to a top 50 and extend over a user's shoulder can have a predetermined length of 105 mm. As yet another example, a linking element 4 configured to extend between a first cup 6*a* and a second cup 6*b* can have a predetermined length of less than 50 mm. Although specific example lengths are provided herein, it will be appreciated that the plurality of ornamental elements 40 may have any suitable length based on a user's measurements, an article clothing, and/or my other additional considerations. In some embodiments, one or more of the plurality of ornamental elements 40 can have a greater or lesser length (see, for example, FIG. 7E).

In some embodiments, a first end of each of the plurality of wires 42 (or, linked ornamental elements 40) is welded 44 to a first linking coupling element 12. In some embodiments, a second end of each of the plurality of wires 42 (or, linked ornamental elements 40) is welded 44 to a second linking coupling element 12. The linking coupling elements 12 may be fabricated from any suitable material, such as, tor example, a non-polished metal material, a polished metal material, a plastic material, and/or any other suitable material. In some embodiments, after being welded 44 together, a reflective finish, such as a chrome finish, is applied to the linking coupling elements 12 and the plurality of wires 42 (or, linked ornamental elements 40). A plurality of ornamental elements 40 are coupled to each of the plurality of wires 42 (or, linked ornamental elements 40) between the linking coupling elements 12. The plurality of ornamental elements 40 can be coupled to the plurality of wires 42 by any suitable method, such as, for example, welding, crimping, threading, and/or any other suitable method.

The ornamental dements 40 can comprise any suitable element, such as, for example, gem stones, rhinestones, beads, sequins, paillettes, and/or any other ornamental element. In some embodiments, the linking element 4 comprises a continuous ornamental element, such as, for example, an ornamental fabric strip, an ornamental metal strip, a chain and/or any other continuous ornamental element. In some embodiments, the linking element 4 can include two or more ornamental elements 40, such as, for example, different sized ornamental elements, a continuous ornamental element having a plurality of individual ornamental elements coupled thereto, and/or any other suitable combination of ornamental elements. The ornamental elements 40 may be arranged in any suitable pattern. For example, FIGS. 7A-7E illustrate various embodiments of linking elements 304*a*-304*e* having various example patterns of linked ornamental elements 40 with linking coupling elements 4 at each end.

In some embodiments, the linking elements 4 are interchangeable such that any of the linking elements 4 may be replaced by an alternate linking element. The alternate linking elements may include first and second alternate linking coupling elements (see FIGS. 7A-7E). The alternate linking elements 4 and can comprise different lengths and/or ornamental appearances allowing a wearer to easily and quickly adjust the fit and/or ornamental appearance of a clothing article 2.

The linking coupling elements 12 and/or the clothing coupling elements 14 may be coupled to respective linking elements 4 and clothing articles 2 by any suitable means. For example, in some embodiments, the linking coupling elements 12 are coupled to the linking elements 4 by welding, gluing, sewing, and/or otherwise permanently attaching the linking coupling elements to the ornamental elements 40 of the linking elements 4. In some embodiments, the linking coupling elements 12 are coupled to the intermediate portion of the linking elements 4 by a loop 27 extending from a lateral edge 26 of the linking coupling element 12. The loop 2 is sized and configured to be slideably received over the lateral edge 26 of the linking coupling element 12 to releasably couple the linking coupling element 12 to the linking element 4.

Similarly, clothing coupling elements 14 can be permanently and/or releasably coupled to the clothing article 2. In the illustrated embodiments, the clothing coupling elements 14 are coupled to or continuous with the clothing article 2. In other embodiments, the clothing coupling elements 14 can be sewn or otherwise permanently attached to the clothing article 2. In some embodiments, the clothing coupling elements 14 are releasably coupled, to the clothing article 2, for example, by a fabric loop formed on the clothing article 2.

FIGS. 4A-4F illustrate various embodiments of linking coupling elements 112*a*-112*f* configured to be coupled to a linking element 4. FIGS. 5A-5F illustrate the various embodiments of linking coupling elements 112*a*-112*f* coupled to a clothing coupling element 14, As will be understood, the structures of the linking coupling elements 4 and the clothing coupling elements 14 can be switched so long as each releasably coupling location includes one of each structure.

FIG. 4A illustrates one embodiment of a linking coupling element 112*a* having a loop receiving projection 124 spaced apart from a securing clip 129. The securing clip 129 includes a primary securing clip 130 extending from a distal end and a secondary securing clip 132 extending from a proximal end. FIG. 5A illustrates one embodiment of the linking coupling element 112*a* coupled to a clothing coupling portion 14. The coupling portion 14 is slideably coupled to the loop receiving portion 124 and threaded through a clip access opening 134 defined between the primary securing clip 130 and the secondary securing clip 132.

FIGS. 4B-4D illustrate embodiments of a linking coupling element 112*b*, 112*c*, 112*d* having a loop receiving projection 124 and a securing projection 125 extending from a first longitudinally-extending edge 20 of the linking coupling element 112*b*, 112*c*, 112*d*. In the embodiments illustrates in FIGS. 4B and 4C, the primary securing clip 130 is located between the loop receiving projection 124 and the securing projection 125. A clip access opening 134 is defined between the primary securing clip 130 and the securing projection 125 along a second longitudinally-extending edge 22 of the linking coupling element 112*b*. Linking coupling element 112*c* includes a secondary securing clip 132 extending from the securing projection 125 towards the loop receiving projection 124. A clip access opening 134 is defined between the primary securing clip 130 and the secondary securing clip 132. In the embodiment illustrated in FIG. 4D, the primary securing clip 130 extends from the securing projection 125 towards the loop receiving projections 124. FIGS. 5B-5D illustrate the linking elements 112*b*, 112*c*, 112*d*, having a loop extending over the loop receiving projection 124 a portion of the clothing article 2 threaded through the clip access opening 134.

FIG. 4E illustrates one embodiment of a linking coupling element 112*e* having a loop receiving projection 124 and a securing projection 125. A primary securing clip 130 extends from a distal end of the securing projection 125. At least a portion of the primary securing clip 130 extends parallel to the securing projection 125 for more than half the length of the securing projection 125. A clip access opening 134 is defined along the first longitudinally-extending edge 20 of the linking coupling element 112*e*. FIG. 5E illustrates the linking coupling element 112*e* coupled to a coupling portion 14.

FIG. 4F illustrates one embodiment of a linking coupling element 112*f* having a primary securing clip 130 extending from a distal end of a loop receiving projection 124. The primary securing clip 130 extends more than half the length of the loop receiving projection 124 and defines a clip access opening 134 along a first longitudinally-extending edge 20 of the linking coupling element 112*f*. FIG. 5F illustrates one embodiment of the linking coupling element 112*f* coupled to a coupling portion 14.

Figure 6A:
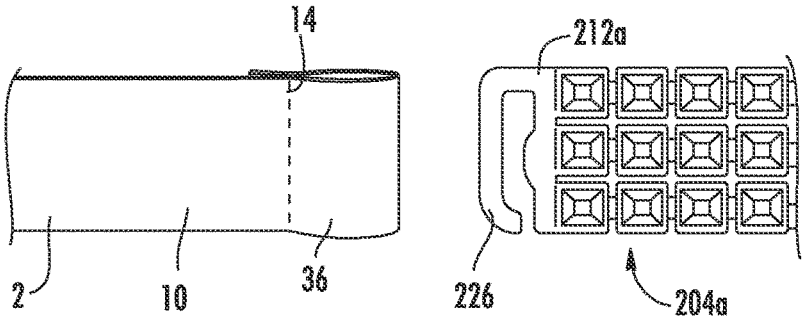
FIGS. 6A-6E illustrates various alternative embodiments of linking elements, in accordance with the present disclosure.
Figure 6B:
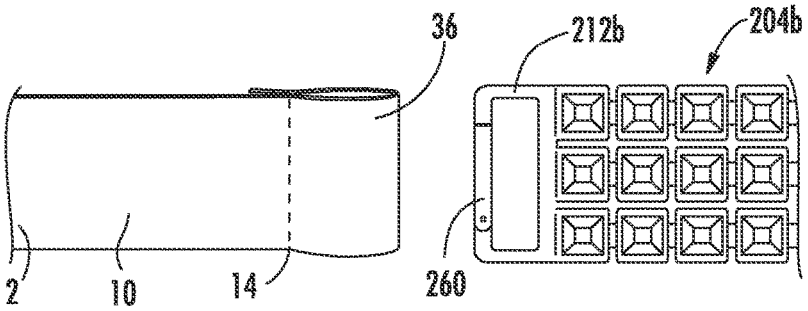
Figure 6C:
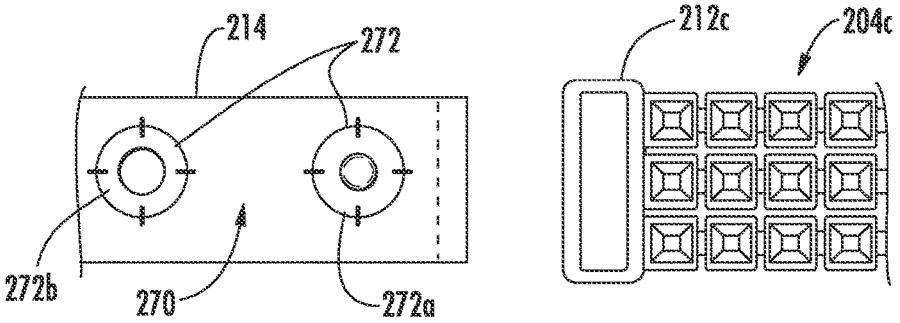

FIGS. 6A-6E illustrate alternative linking elements 204*a*-204*e* having alternative linking coupling elements 212*a*-212*e*. Linking element 204*a* illustrates one embodiment of a linking coupling element 212*a* without a loop receiving projection. The coupling portion 14 of the clothing strap 10 is coupled directly to a primary securing clip 226 extending from the linking element 204*a*. FIG. 6B illustrates one embodiment of a linking coupling element 212*b* having a hinged gate 260. The hinged gate 260 is pivotably moveable at a first end 262 to allow the fabric loop 36 to be received within the linking coupling element 204*b*. FIG. 6C illustrates one embodiment of a linking coupling element 204*c* having a closed linking coupling element 212*c*. The coupling element 214 comprises a selectively closeable loop 270. The selectively closeable loop 270 includes a fastener 272, such as a snap or button. In the illustrated embodiment, the selectively closeable loop 270 includes a first section 272*a* and a second section 276. In operation, the first snap section 274 is threaded through the closed linking element 212*c*. The coupling element 214 is folded over a loop retaining post 224 and the first portion 274 is coupled to the second portion 276 to couple the coupling element 214 to the linking coupling element 212*c*.

Figure 6D:
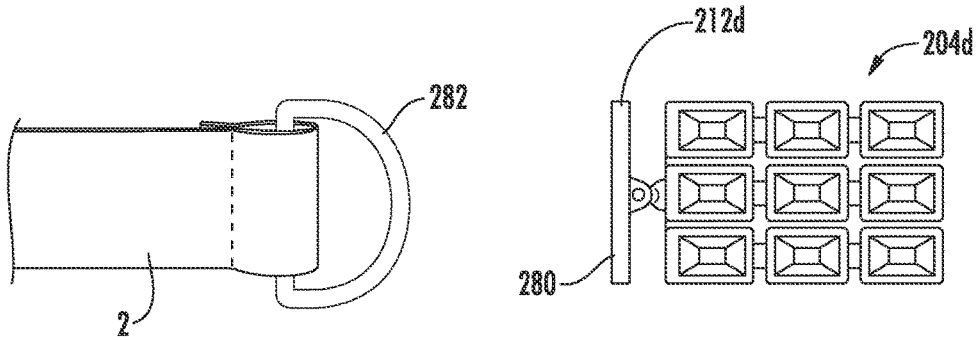
Figure 6E:
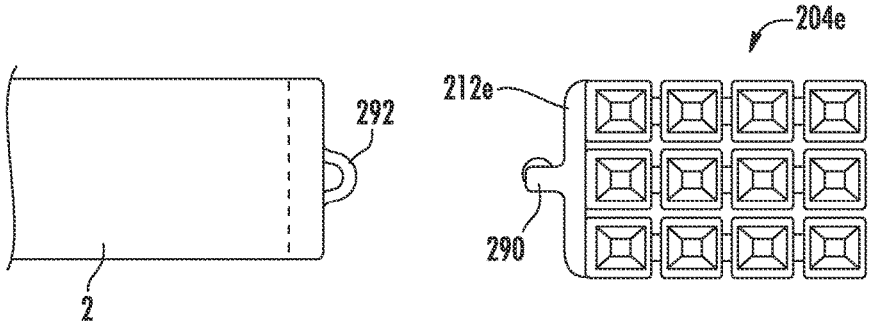

FIG. 6D illustrates one embodiment of an alternative linking element 204*d*. The linking element 204*d* includes an alternative linking coupling element 212*d*. The linking coupling element 212*d* includes a link bar 280 coupled to a chain 282. The link bar 280 is sized and configured to be received within a link 284 coupled to the clothing article 2. The link bar 280 is sized and configured such that the link bar 280 passes through the link in a first, longitudinal direction. After being inserted through the link 284, the link bar 280 is rotated 90 degrees and is retained by the link 284. FIG. 6E illustrates one embodiment of an alternative linking element 204*e*. The linking element 204*e* includes an alternative linking coupling element 212*e*. The linking coupling element 212*e* includes a hook 290 located at a first end of the linking element 204*e*. An eyelet 292 is formed on the clothing article 2 and is sized and configured to receive the hook 290 therein.

FIGS. 7A-7E illustrate embodiments of linking dements 304*a*-304*e* having various ornamental designs, in accordance with the present disclosure. As shown in FIGS. 7A-7E, the linking elements 304*a*-304*e* may have any suitable ornamental design that extends generally longitudinal between a first end and a second end of the linking element 304*a*-304*e*. Although various example ornamental designs are illustrated herein, it will be appreciated that additional ornamental designs are possible and within the scope of this disclosure.

Figure 8:
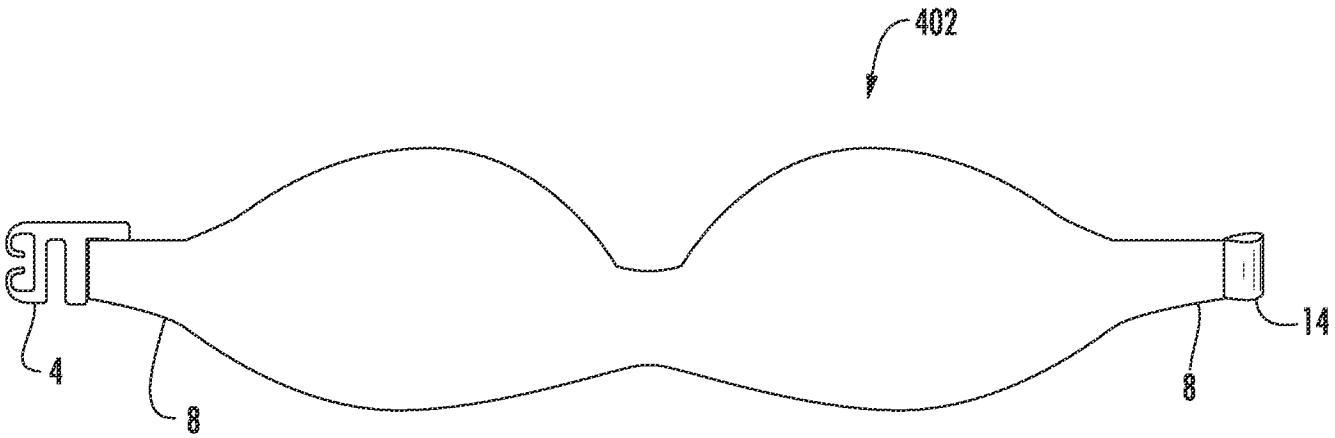
FIG. 8 illustrates one embodiment of a clothing article having a linking coupling element and a clothing coupling element coupled directly thereto.

FIG. 8 illustrates one embodiment of a clothing article 402 having a linking coupling element 4 and a clothing coupling element 14 coupled directly thereto. In the illustrated embodiment, the clothing article 402 comprises a strapless bikini top. The linking coupling element 4 is coupled to a first end of a chest strap 8 and the clothing coupling element 14 is coupled to a second end of the chest strap 8. The linking coupling element 4 and the clothing coupling element 14 are configured to maintain the clothing article 2 in place on a wearer when coupled together. The linking coupling element 4 and/or the clothing coupling element 14 may be coupled to the clothing article 2 by any suitable means, such as, for example, permanently coupled, for example by sewing, welding, gluing, etc. and/or releasably coupled, for example, by a loop of fabric formed at an end of the chest strap 8. The linking coupling element 4 and the clothing coupling element 14 replace a traditional connector, such as, for example, a snap or clip. Although a strapless bikini top is illustrated herein, it will be appreciated that the linking coupling element 4 and the clothing element 14 may replace any traditional clothing connection element, such as, for example, buttons, snaps, zippers, ties, and/or any other traditional clothing connecting element on a clothing article. In addition, although the clip 12 shown is consistent with FIG. 2, it will be understood that any of the clips shown herein (e.g., FIGS. 3 & 4A-4F can also be used in its place.

Although the subject matter has been described in terms of exemplary embodiments, it is not limited thereto. Rather, the appended claims should be construed broadly, to include other variants and embodiments, which may be made by those skilled in the art.

The invention claimed is:

1. A clothing system, comprising:

a clothing component, comprising a first coupling portion, comprising a first clothing coupling element, and a second coupling portion comprising a second clothing coupling element; and a linking element, comprising first and second linking coupling elements at opposite ends of the linking element, wherein each of the first linking coupling element and the second linking coupling element is a clasp, comprising a lateral edge, a loop receiving projection extending from a first longitudinally-extending edge of the clasp, a primary securing clip extending from a distal end of the loop receiving projection, and a secondary securing clip extending from a proximal end of the loop receiving projection, wherein a longitudinally-extending clip access opening is located between the primary securing clip and the secondary securing clip, wherein said lateral edge and said loop receiving projection are spaced-apart laterally to form a loop receiving cavity opening along a second longitudinally-extending edge opposite the first longitudinally-extending edge, wherein each of the first clothing coupling element and the second clothing coupling element is a loop adapted for sliding over said loop receiving projection, wherein the first and second clothing coupling elements are adapted to be removably coupled to the first and second linking coupling elements, respectively, and wherein, when the clothing component and the linking element are coupled together, they comprise at least a portion of an article of clothing that can be worn by a wearer.

2. The clothing system of claim 1, wherein said loop is adapted to fit over said loop receiving projection and said primary and secondary securing clips when coupling or decoupling said loop from said clasp.

3. The clothing system of claim 1, wherein said loop is adapted to fit over said loop receiving projection and said primary securing clip.

4. The clothing system of claim 1, further comprising a securing projection extending from the first longitudinally-extending edge of said clasp, wherein said primary securing clip extends from a distal end of said securing projection and wherein said securing projection is located between said loop receiving projection and said primary securing clip.

5. The clothing system of claim 4, wherein said loop is adapted to fit over said loop receiving projection and said primary securing clip.

6. The clothing system of claim 1, further comprising an alternate linking element, said alternate linking element comprises first and second alternate linking coupling elements at opposite ends of the alternate linking element, wherein the first and second alternate linking coupling element is interchangeable with the first and second linking coupling elements, respectively.

7. The clothing system of claim 1, wherein the article of clothing is selected from the group consisting of a bikini top, a bikini bottom, a one-piece bathing suit, two-piece bathing suit, figure suit, physique suit, bodybuilding suit, and posing suit.

* * * * *